US011125529B2

(12) United States Patent
Yoon

(10) Patent No.: US 11,125,529 B2
(45) Date of Patent: Sep. 21, 2021

(54) BULLET DECELERATOR FOR TOY GUN

(71) Applicant: Sang su Yoon, Seoul (KR)

(72) Inventor: Sang su Yoon, Seoul (KR)

( * ) Notice: Subject to any disclaimer, the term of this patent is extended or adjusted under 35 U.S.C. 154(b) by 260 days.

(21) Appl. No.: 16/397,035

(22) Filed: Apr. 29, 2019

(65) Prior Publication Data

US 2020/0340777 A1 Oct. 29, 2020

(51) Int. Cl.
*F41B 11/89* (2013.01)
*F41A 21/32* (2006.01)

(52) U.S. Cl.
CPC ..... *F41B 11/89* (2013.01); *F41A 21/32* (2013.01)

(58) Field of Classification Search
CPC ..... F41A 21/32; F41B 11/00; F41B 11/89
USPC ..... 124/56, 73, 83, 85, 81; 42/76.01
See application file for complete search history.

(56) References Cited

U.S. PATENT DOCUMENTS 2,574,408 A * 11/1951 Moe ..... A63B 69/409 124/73
2,630,108 A * 3/1953 White ..... F41B 11/50 124/65
2,725,869 A * 12/1955 Barber ..... F41B 7/003 124/66
4,014,307 A * 3/1977 Horvath ..... A63B 69/409 124/81
4,674,470 A * 6/1987 Tsukiji ..... F41B 11/52 124/44.7
4,947,729 A * 8/1990 Downey ..... F41A 21/32 89/14.4
5,343,849 A * 9/1994 Steer ..... F41B 11/55 124/69
5,377,655 A * 1/1995 Arad ..... F41B 11/55 124/63
5,450,838 A * 9/1995 Nakahigashi ..... F41B 11/00 124/56
5,735,256 A * 4/1998 Monk ..... A63B 69/409 124/65
5,823,173 A * 10/1998 Slonaker ..... F41A 21/00 124/56
5,988,153 A * 11/1999 Yoshimura ..... F41B 11/00 124/81
6,698,128 B2 * 3/2004 Kessler ..... F41A 21/00 124/83
6,805,111 B2 * 10/2004 Tippmann, Jr. ..... F41A 21/00 124/74

(Continued)

*Primary Examiner* — Alexander R Niconovich
(74) *Attorney, Agent, or Firm* — Dinsmore & Shohl LLP; Yongsok Choi, Esq.

(57) ABSTRACT

A bullet decelerator for a toy gun. In one embodiment, there is provided a bullet decelerator for a toy gun comprising: a first housing having a first outlet, a second housing having a second outlet formed on one end of the second housing, wherein the second housing is screw-coupled to the first housing, and an elastic ring disposed within the first housing. The elastic ring is configured to maintain or reduce speed of the bullet discharged from the second outlet. The first housing includes a first cover unit having the first outlet and a second cover unit integrally connected to the first cover unit configured to accommodate the elastic ring therein. A first screw thread is formed on at least a portion of an inner circumferential surface of the second cover unit, and the first screw thread is configured to couple the first housing and the second housing.

6 Claims, 14 Drawing Sheets

(56) References Cited

U.S. PATENT DOCUMENTS

| | | | | |
|---|---|---|---|---|
| 6,904,901 | B2 * | 6/2005 | Mitchell | F41B 11/641 124/65 |
| 7,421,935 | B2 * | 9/2008 | Ho | F41A 17/44 124/80 |
| 7,565,902 | B2 * | 7/2009 | Levin | F41A 11/02 124/56 |
| 7,603,998 | B2 * | 10/2009 | Finstad | F41B 11/00 124/73 |
| 8,037,877 | B2 * | 10/2011 | Liao | F41A 21/12 124/44.7 |
| 8,714,146 | B2 * | 5/2014 | Hu | F41B 11/00 124/84 |
| 9,062,928 | B2 * | 6/2015 | Appleton | F41A 21/32 |
| 9,103,624 | B1 * | 8/2015 | Kung | F41A 21/16 |
| 9,188,404 | B2 * | 11/2015 | Camilleri | F41A 21/32 |
| 10,088,262 | B2 * | 10/2018 | McMillan | F41A 21/28 |
| 10,222,168 | B2 * | 3/2019 | Liao | F41B 11/70 |
| 10,731,940 | B2 * | 8/2020 | McMillan | F41A 21/36 |
| 2007/0017498 | A1 * | 1/2007 | Finstad | F41A 21/32 124/84 |
| 2007/0125351 | A1 * | 6/2007 | Campo | F41B 11/62 124/56 |
| 2011/0271941 | A1 * | 11/2011 | Meggs | F41B 11/641 124/65 |
| 2014/0007857 | A1 * | 1/2014 | Schlosser | F41A 21/16 124/81 |

* cited by examiner

UNIT: fps

| INNER DIAMETER OF FIRST COVER UNIT | 8.5mm | | | 9.0mm | | | 9.5mm | | |
|---|---|---|---|---|---|---|---|---|---|
| THICKNESS OF ELASTIC RING | 2mm | 3mm | 4mm | 2mm | 3mm | 4mm | 2mm | 3mm | 4mm |
| No. 1 | 153 | 151 | x | 152 | 152 | 153 | 153 | 151 | 150 |
| No. 2 | 154 | 151 | x | 151 | 151 | 151 | 151 | 151 | 151 |
| No. 3 | 152 | 152 | x | 152 | 152 | 152 | 152 | 152 | 151 |
| No. 4 | 156 | 150 | x | 150 | 151 | 154 | 150 | 153 | 150 |
| No. 5 | 148 | 153 | x | 153 | 153 | 152 | 149 | 153 | 150 |
| No. 6 | 145 | 152 | x | 152 | 152 | 152 | 89 | 152 | 151 |
| No. 7 | 151 | 154 | x | 154 | 154 | 154 | 305 | 152 | 152 |
| No. 8 | 152 | 156 | x | 150 | 150 | 150 | 304 | 150 | 152 |
| No. 9 | 153 | 152 | x | 152 | 152 | 152 | 303 | 152 | 151 |
| No. 10 | 150 | 152 | x | 150 | 150 | 150 | 305 | 150 | 152 |
| No. 11 | 149 | 149 | x | 151 | 149 | 151 | 304 | 151 | 150 |
| No. 12 | 148 | 149 | x | 150 | 150 | 150 | 303 | 150 | 152 |
| No. 13 | 153 | 152 | x | 152 | 152 | 152 | 301 | 152 | 153 |
| No. 14 | 155 | 151 | x | 151 | 151 | 151 | 304 | 151 | 153 |
| No. 15 | 154 | 153 | x | 151 | 153 | 151 | 302 | 151 | 153 |
| No. 16 | 150 | 152 | x | 153 | 153 | 153 | 303 | 153 | 152 |
| No. 17 | 152 | 154 | x | 152 | 152 | 152 | 303 | 152 | 152 |
| No. 18 | 152 | 156 | x | 152 | 154 | 152 | 301 | 152 | 153 |
| No. 19 | 154 | 157 | x | 153 | 153 | 153 | 304 | 153 | 154 |
| No. 20 | 149 | 157 | x | 152 | 150 | 152 | 302 | 152 | 153 |
| Average | 151.5 | 152.7 | x | 151.7 | 151.7 | 151.9 | 254.4 | 151.7 | 151.8 |

FIG. 11

UNIT: fps

| INNER DIAMETER OF FIRST COVER UNIT | 8.5mm | | | 9.0mm | | | 9.5mm | | |
|---|---|---|---|---|---|---|---|---|---|
| THICKNESS OF ELASTIC RING | 2mm | 3mm | 4mm | 2mm | 3mm | 4mm | 2mm | 3mm | 4mm |
| No. 1 | 153 | 151 | x | 151 | 152 | 153 | 153 | 151 | 150 |
| No. 2 | 150 | 152 | x | 150 | 150 | 151 | 151 | 151 | 151 |
| No. 3 | 146 | 150 | x | 150 | 150 | 150 | 145 | 152 | 151 |
| No. 4 | 130 | 148 | x | 147 | 145 | 145 | 146 | 153 | 150 |
| No. 5 | 130 | 146 | x | 146 | 140 | 146 | 143 | 153 | 150 |
| No. 6 | 132 | 143 | x | 143 | 140 | 143 | 138 | 152 | 151 |
| No. 7 | 129 | 142 | x | 142 | 141 | 142 | 135 | 152 | 152 |
| No. 8 | 120 | 130 | x | 130 | 138 | 138 | 138 | 150 | 152 |
| No. 9 | 110 | 128 | x | 128 | 138 | 135 | 136 | 152 | 151 |
| No. 10 | 110 | 120 | x | 120 | 135 | 132 | 132 | 150 | 152 |
| No. 11 | 113 | 119 | x | 119 | 132 | 120 | 112 | 151 | 150 |
| No. 12 | 112 | 118 | x | 120 | 129 | 118 | 75 | 150 | 152 |
| No. 13 | 120 | 122 | x | 122 | 128 | 110 | 260 | 152 | 153 |
| No. 14 | 115 | 115 | x | 115 | 129 | 101 | 265 | 151 | 153 |
| No. 15 | 105 | 113 | x | 63 | 125 | 98 | 250 | 151 | 153 |
| No. 16 | 108 | 114 | x | 260 | 116 | 87 | 253 | 153 | 152 |
| No. 17 | 101 | 115 | x | 256 | 18 | 79 | 249 | 152 | 152 |
| No. 18 | 102 | 110 | x | 253 | 115 | x | 251 | 152 | 153 |
| No. 19 | 103 | 109 | x | 248 | 114 | x | 246 | 153 | 154 |
| No. 20 | 104 | 108 | x | 240 | 113 | x | 243 | 152 | 153 |
| Average | 119.7 | 127.7 | x | 160.2 | 127.4 | 107.4 | 181.1 | 151.7 | 151.8 |

FIG. 12

UNIT: fps

| INNER DIAMETER OF FIRST COVER UNIT | 8.5mm | | | 9.0mm | | | 9.5mm | | |
|---|---|---|---|---|---|---|---|---|---|
| THICKNESS OF ELASTIC RING | 2mm | 3mm | 4mm | 2mm | 3mm | 4mm | 2mm | 3mm | 4mm |
| No. 1 | 153 | 151 | x | 152 | 152 | 153 | 153 | 151 | 150 |
| No. 2 | 151 | 151 | x | 151 | 151 | 151 | 110 | 151 | 151 |
| No. 3 | 152 | 152 | x | 152 | 152 | 152 | 78 | 152 | 151 |
| No. 4 | 150 | 150 | x | 150 | 151 | 154 | 61 | 153 | 150 |
| No. 5 | 149 | 153 | x | 153 | 153 | 152 | 300 | 153 | 150 |
| No. 6 | 152 | 152 | x | 152 | 152 | 152 | 302 | 152 | 151 |
| No. 7 | 154 | 154 | x | 154 | 154 | 154 | 303 | 152 | 152 |
| No. 8 | 156 | 156 | x | 150 | 150 | 150 | 304 | 150 | 152 |
| No. 9 | 152 | 152 | x | 152 | 152 | 152 | 302 | 152 | 151 |
| No. 10 | 152 | 152 | x | 150 | 150 | 150 | 305 | 150 | 152 |
| No. 11 | 149 | 149 | x | 151 | 149 | 151 | 306 | 151 | 150 |
| No. 12 | 149 | 149 | x | 150 | 150 | 150 | 306 | 150 | 152 |
| No. 13 | 152 | 152 | x | 152 | 152 | 152 | 305 | 152 | 153 |
| No. 14 | 151 | 151 | x | 151 | 151 | 151 | 304 | 151 | 153 |
| No. 15 | 153 | 153 | x | 151 | 153 | 151 | 302 | 151 | 153 |
| No. 16 | 152 | 152 | x | 153 | 153 | 153 | 303 | 153 | 152 |
| No. 17 | 154 | 154 | x | 152 | 152 | 152 | 302 | 152 | 152 |
| No. 18 | 156 | 156 | x | 152 | 154 | 152 | 305 | 152 | 153 |
| No. 19 | 154 | 157 | x | 153 | 153 | 153 | 304 | 153 | 154 |
| No. 20 | 150 | 157 | x | 152 | 150 | 152 | 305 | 152 | 153 |
| **Average** | **152.1** | **152.7** | **x** | **151.7** | **151.7** | **152** | **263** | **151.7** | **151.8** |

FIG. 13

UNIT: fps

| INNER DIAMETER OF FIRST COVER UNIT | 8.5mm | | | 9.0mm | | | 9.5mm | | |
|---|---|---|---|---|---|---|---|---|---|
| THICKNESS OF ELASTIC RING | 2mm | 3mm | 4mm | 2mm | 3mm | 4mm | 2mm | 3mm | 4mm |
| No. 1 | 153 | 154 | x | 155 | 154 | 153 | 153 | 155 | 154 |
| No. 2 | 151 | 152 | x | 152 | 152 | 151 | 146 | 152 | 152 |
| No. 3 | 147 | 150 | x | 150 | 150 | 143 | 140 | 149 | 150 |
| No. 4 | 134 | 139 | x | 136 | 139 | 135 | 132 | 137 | 139 |
| No. 5 | 132 | 137 | x | 135 | 137 | 129 | 125 | 132 | 137 |
| No. 6 | 130 | 130 | x | 133 | 132 | 122 | 120 | 128 | 132 |
| No. 7 | 126 | 122 | x | 128 | 130 | 119 | 110 | 126 | 130 |
| No. 8 | 110 | 111 | x | 123 | 122 | 112 | 110 | 120 | 122 |
| No. 9 | 108 | 101 | x | 118 | 113 | 101 | 120 | 114 | 113 |
| No. 10 | 110 | 94 | x | 110 | 110 | 90 | 152 | 111 | 110 |
| No. 11 | 108 | 91 | x | 109 | 110 | 89 | 249 | 110 | 110 |
| No. 12 | 103 | 81 | x | 106 | 100 | 80 | 230 | 100 | 100 |
| No. 13 | 100 | 70 | x | 103 | 92 | 71 | 231 | 98 | 92 |
| No. 14 | 99 | x | x | 101 | 81 | 60 | 220 | 89 | 81 |
| No. 15 | 90 | x | x | 98 | 76 | x | 210 | 82 | 76 |
| No. 16 | 82 | x | x | 95 | 90 | x | 208 | 80 | 90 |
| No. 17 | 81 | x | x | 91 | 89 | x | 198 | 79 | 89 |
| No. 18 | 78 | x | x | 86 | 82 | x | 180 | 76 | 82 |
| No. 19 | 68 | x | x | 82 | 80 | x | 190 | 74 | 80 |
| No. 20 | 68 | x | x | 75 | 72 | x | 179 | 72 | 72 |
| Average | 108.9 | 76.6 | x | 114.3 | 110.6 | 77.8 | 170.2 | 109.2 | 110.6 |

FIG. 14

BULLET DECELERATOR FOR TOY GUN

TECHNICAL FIELD

The present disclosure relates to a bullet decelerator for a toy gun, and more specifically, to a toy gun bullet decelerator which is coupled to a muzzle of a toy gun to reduce speed of a bullet.

BACKGROUND

A survival game is one kind of mock battle game wherein a toy gun is used. The survival game is a game in which game participants gain enjoyment through a mock battle similar to an actual battle while carrying a toy gun which continuously fires bullets and using a variety of military equipment. The survival game has been widely played by many Korean and foreign clubs.

Recently, in order to execute a realistic battle during the survival game, demand for a high performance toy gun has been increasing. As a result, toy guns, which have similar exterior to actual automatic rifles, increased effective firing range, improved bullet speed, and improved rapid firing ability, are being manufactured and introduced into the market.

Most conventional inventions related to a toy gun have been able to secure a realistic mock battle for a user by increasing firing speed of a bullet fired from the toy gun and increasing effective firing range of the bullet. However, when a user located at a short distance from the toy gun is hit by a bullet fired at an accelerated speed, the user may suffer serious damages.

SUMMARY

According to one aspect of the present invention, there is provided a bullet decelerator for a toy gun, comprising: a first housing having a first outlet, wherein a bullet is discharged from the first outlet; a second housing having a second outlet formed on one end of the second housing, wherein the bullet is discharged from the second outlet and the second housing is screw-coupled to the first housing; and an elastic ring disposed within the first housing, the elastic ring is configured to maintain or reduce speed of the bullet discharged from the second outlet, wherein the first housing including: a first cover unit having the first outlet; and a second cover unit integrally connected to the first cover unit configured to accommodate the elastic ring therein, a first screw thread is formed on at least a portion of an inner circumferential surface of the second cover unit, the first screw thread is configured to couple the first housing and the second housing, and the elastic ring is formed of silicone rubber.

In one embodiment of the present invention, one side surface of the elastic ring is supported by the first cover unit, and an inner diameter of the elastic ring decreases as a thickness of the elastic ring decreases by the second housing applying pressure to an opposite side surface of the elastic ring.

In one embodiment of the present invention the second housing includes: a first insertion unit having the second outlet, the first insertion unit applies pressure to the elastic ring; and a second insertion unit integrally connected to the first insertion unit having an outer circumferential surface on which a second screw thread is formed, wherein the second screw thread correspondingly couples to the first screw thread.

In one embodiment of the present invention, the second housing further includes a coupling unit integrally connected to the second insertion unit configured to be coupled to a muzzle.

In one embodiment of the present invention, the coupling unit has a third screw thread formed on an inner circumferential surface of the coupling unit, the third screw thread is configured to be screw-coupled to the muzzle.

In one embodiment of the present invention, the coupling unit has a through-hole communicating with a communication hole formed in the muzzle, and a coupling member is inserted into the through-hole and the communication hole to couple the coupling unit to the muzzle.

In one embodiment of the present invention, the first cover unit has an inner diameter of 8.95 mm to 9.05 mm.

BRIEF DESCRIPTION OF THE DRAWINGS

Embodiments of the present invention will be described, by way of example only, and with reference to the following drawings.

FIG. 11 shows a table illustrating bullet speed of an electric airsoft gun with a bullet decelerator attached thereto at room temperature.

FIG. 12 shows a table illustrating bullet speed of a gas-powered airsoft gun with a bullet decelerator attached thereto at room temperature.

FIG. 13 shows a table illustrating bullet speed of an electric airsoft gun with a bullet decelerator attached thereto at a low temperature.

FIG. 14 shows a table illustrating bullet speed of a gas-powered airsoft gun with a bullet decelerator attached thereto at a low temperature.

DETAILED DESCRIPTION

Figure 1:
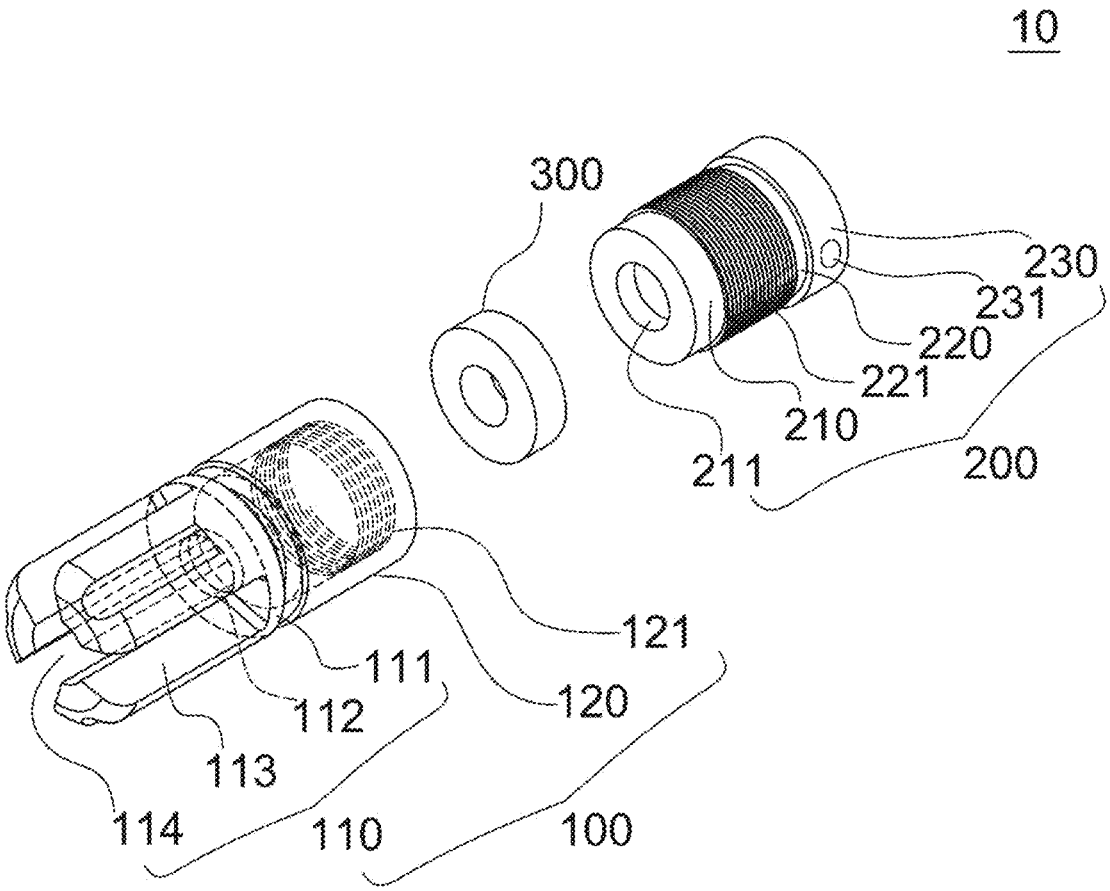
FIG. 1 shows an exploded perspective view of a bullet decelerator for a toy gun according to an embodiment of the present disclosure.

The present disclosure is related to a bullet decelerator for a toy gun that can prevent accidents by selectively discharging a bullet at the original speed or a reduced safety speed. The bullet decelerator may be coupled to the muzzle of the toy gun.

Hereinafter, embodiments of the present disclosure will be described in detail with reference to the accompanying drawings. It should be noted that in the drawings, like components or parts may be represented by like reference numerals, if possible. In describing the present disclosure, when a detailed description about a related well-known art may obscure the gist of the present disclosure, the detailed description thereof will not be provided.

Herein, an upper side of the drawing may be referred to as an "upper portion" or "upper side" of a component shown in the drawing, and a lower side of the drawing may be referred to as a "lower portion" or "lower side" of a component shown in the drawing. In addition, a portion between an upper portion and a lower portion of a component shown in the drawing or the remaining portion except for the upper portion and the lower portion may be referred to as a "side portion" or "side surface".

In the accompanying drawings, like or relevant components may be indicated by like reference numerals. In the following description of the embodiments, repeated descriptions of the identical or relevant components may be omitted. However, even if a description of a component is omitted, such a component is not intended to be excluded in an embodiment. The relative terms such as the terms "upper portion" and "upper side" may be used to describe a relationship between components shown in the drawings, and the present disclosure is not limited to the terms.

FIG. 1 shows an exploded perspective view of a bullet decelerator 10 for a toy gun according to an embodiment of the present disclosure. As shown in FIG. 1, the bullet decelerator 10 for a toy gun according to the present disclosure comprises a first housing 100, a second housing 200 that is screw-coupled to the first housing 100, and at least one elastic ring 300 inserted into the first housing 100 for maintaining or reducing the speed of a bullet. The bullet decelerator 10 for a toy gun may be configured to be detachable from or attachable to a toy gun (for example, an airsoft gun).

Figure 2:
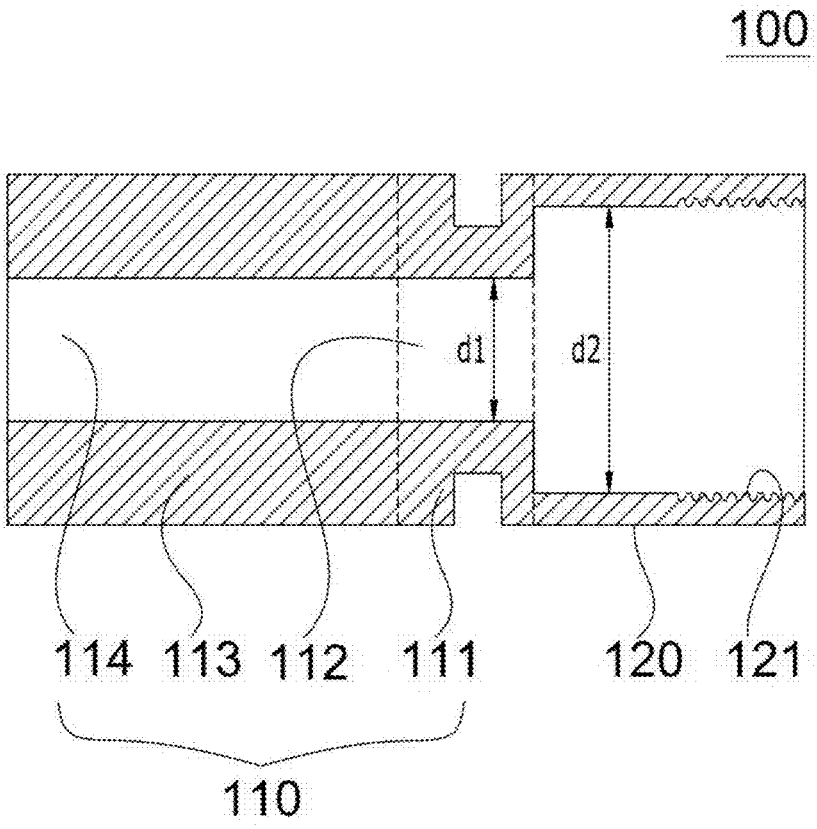
FIG. 2 shows a cross-sectional view of a first housing according to an embodiment of the present disclosure.

FIG. 2 shows a cross-sectional view of a first housing 100 according to an embodiment of the present disclosure. As shown in FIG. 2, the first housing 100 may include a first cover unit 110 and a second cover unit 120 integrally connected to the first cover unit 110. The first cover unit 110 may be configured to include a circular member 111 and a plurality of column members 113 integrally connected to the circular member 111 in a direction perpendicular to the circular member 111. A first outlet 112 may be formed in a central portion of the circular member 111, and a bullet fired from a muzzle 20 of the toy gun may pass through the first outlet 112 of the circular member 111 and be ejected to the outside of the first cover unit 110.

When the toy gun uses a 6 mm bullet, the bullet may have an actual diameter of 5.95 mm, and there may be a size deviation of 0.01 mm due to manufacturing processes. For example, the bullet may be a plastic ball, a paint ball, a ball bearing, or the like. In this case, an inner diameter d1 of the first cover unit, i.e., a diameter of the first outlet may be in a range of 8.95 mm to 9.05 mm and, preferably, about 9 mm.

The column members 113 of the first housing 100 may be formed in a column shape having a width that gradually decreases from an outer surface to an inner surface thereof. A curvature of an outer surface of the column members 133 of the first housing 100 is the same as a curvature of an outer surface of the circular member 111, and a curvature of an inner surface of the column members 133 may be the same as a curvature of an inner circumferential surface of the circular member 111.

In addition, the column members 113 may be disposed on the circular member 111 so as to be spaced a predetermined gap from each other on a concentric circle with respect to the first outlet 112 and thus may form a guide path 114 configured to guide the bullet to move to the outside of the first outlet 112. Herein, the guide path 114 may guide a linear movement of a bullet discharged from the first outlet 112. For example, when the bullet ejected to the outside of the first outlet 112 is to deviate from a straight path, the bullet may come into contact with the column member 113 forming the guide path 114 to prevent the bullet from deviating from the straight path, thereby guiding the straight movement of the bullet.

The second cover unit 120 may be integrally connected to the first cover unit 110 and may accommodate the elastic ring 300 therein. The elastic ring 300 may be disposed inside the second cover unit 120, where one side surface of the elastic ring 300 is supported by the first cover unit 110, and the other/opposite side surface of the elastic ring 300 is pressed by a first insertion unit 210.

In addition, the second cover unit 120 may be fixedly coupled to the second housing 200. An inner diameter d2 of the second cover unit may be in a range of 13.95 mm to 14.05 mm, and preferably, about 14 mm. In one embodiment, the second cover unit 120 may have a first screw thread 121 formed on at least a portion of an inner circumferential surface thereof and may be fixedly coupled to the second housing 200 complementary to the first screw thread 121. Specifically, the first screw thread 121 of the second cover unit 120 may be screw-coupled to a second insertion unit 220 of the second housing 200 as described below.

Figure 3:
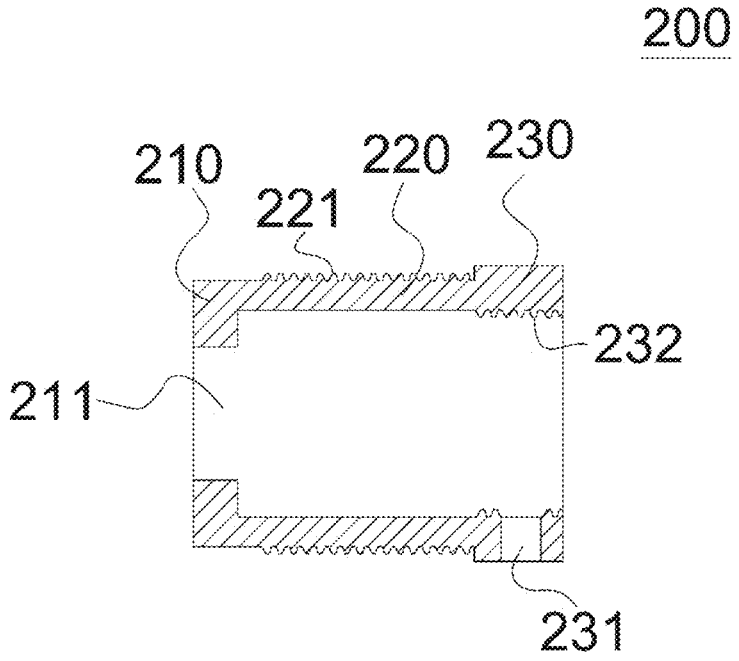
FIG. 3 shows a cross-sectional view of a second housing according to one embodiment of the present disclosure.

FIG. 3 shows a cross-sectional view of a second housing 200 according to one embodiment of the present disclosure. The second housing 200 may include a first insertion unit 210, a second insertion unit 220 integrally connected to the first insertion unit 210, and a coupling unit 230 integrally connected to the second insertion unit 220. As shown in FIG. 3, the first insertion unit 210 may have a second outlet 211 formed at a center thereof. A bullet fired from the muzzle 20 of the toy gun may be ejected to the outside of the first insertion unit 210 through the second outlet 211 of the first insertion unit 210. A diameter of the second outlet 211 may be in a range of 8.95 mm and 9.05 mm and, preferably, about 9 mm.

When the first housing 100 and the second housing 200 are fixedly coupled (for example, screw-coupled), the first insertion unit 210 may apply pressure to the elastic ring 300 inserted into the second cover unit 120 by a force resulting from the fixed coupling of the first housing 100 and the second housing 200. An inner diameter of the elastic ring 300 may vary due to the force applied by the first housing.

The second insertion unit 220 may be integrally connected to the first insertion unit 210 and may be fixedly coupled to the second cover unit 120 of the first housing 100. In one embodiment, the second insertion unit 220 may have a second screw thread 221 formed on an outer circumferential surface thereof so as to be correspondingly coupled to the first screw thread 121 of the second cover unit 120. Thus, by fixedly coupling (for example, screw-coupling) the second cover unit 120 and the second insertion unit 220 via the correspondingly coupling between the first screw thread 121 and the second screw thread 221, the first housing 100 and the second housing 200 may be fixedly coupled to each other.

Figure 10:
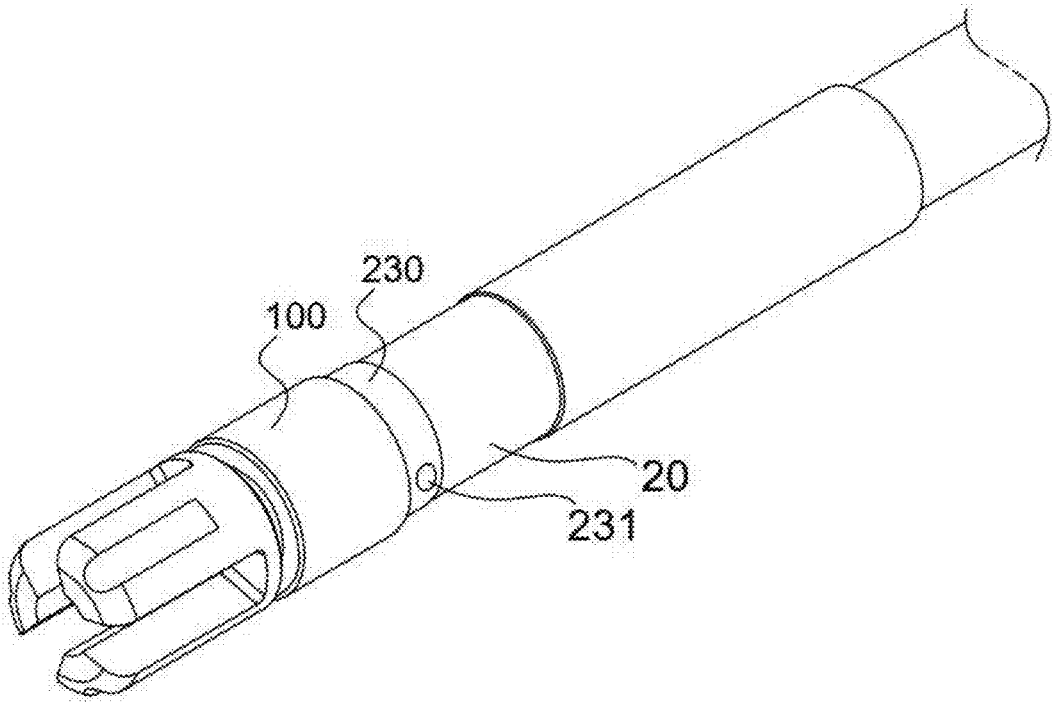
FIG. 10 shows a bullet decelerator for a toy gun according to one embodiment of the present disclosure installed the muzzle of the toy gun.

FIG. 10 shows a bullet decelerator for a toy gun according to one embodiment of the present disclosure installed the muzzle of the toy gun. As shown in FIG. 10, the coupling unit 230 may be coupled to the muzzle 20 of the toy gun. Specifically, the coupling unit 230 may have a through-hole 231 capable of communicating with a communication hole (not shown) formed in the muzzle 20. The coupling unit 230 may have a third screw thread 232 formed on an inner circumferential surface so as to be correspondingly coupled to a thread (not shown) formed on an outer circumferential surface of the muzzle 20. The coupling unit 230 may fixed to the muzzle 20 by inserting a coupling member (not shown) sequentially into the through-hole 231 and the communication hole (not shown) while the coupling unit 230 is screw-coupled to the muzzle 20.

That is, a user may insert the muzzle 20 into the coupling unit 230 by coupling the screw thread (not shown) formed in the muzzle 20 and the third screw thread 232 formed in the coupling unit 230. In addition, the user may fix the coupling unit 230 to the muzzle 20 by positioning the coupling unit 230 and the muzzle 20 such that the through-hole 231 and the communication hole (not shown) align with each other and then successively inserting the coupling member (not shown), for example, a hexagonal screw, into the through-hole 231 and the communication hole (not shown), thereby affixing the bullet decelerator 10 the muzzle 20.

The elastic ring 300 may be inserted into the first housing 100. A bullet discharged from the second outlet 211 may pass an inner diameter of the elastic ring 300 and exit the first housing 100. In this case, the inner diameter of the elastic ring 300 may vary due to external force applied by the second cover unit 120 of the first housing 100 and the first insertion unit 210 of the second housing 200, thereby applying frictional force to the bullet causing speed reduction.

Furthermore, when external force is applied to the elastic ring 300, a thickness of the elastic ring 300 may decrease causing the shape of the elastic ring 300 to change. Specifically, an outer diameter of the elastic ring 300 may be the same as an inner diameter of the second cover unit 120 (d2), and the elastic ring 300 may be positioned inside the second cover unit 120. In this case, when external force is applied to the elastic ring 300, the thickness of the elastic ring 300 may decrease causing the inner diameter of the elastic ring 300 to decrease also.

That is, when the first insertion unit 210 applies pressure to the elastic ring 300, the shape of the elastic ring 300 may change by the pressure applied thereto. In this case, since the outer diameter of the elastic ring 300 is fixed by the inner diameter of the second cover unit 120, the inner diameter of the elastic ring 300 may decrease while the thickness of the elastic ring 300 decreases rather than the outer diameter of the elastic ring 300 increases while the thickness of the elastic ring 300 decreases. Here, when the changed inner diameter is less than or equal to the diameter of the bullet discharged from the second outlet 211, the speed of the bullet may be reduced by frictional force between the elastic ring 300 and the bullet.

On the other hand, when the shape of the elastic ring 300 is not changed by external force, the elastic ring 300 does not provide frictional force to the bullet discharged from the second outlet 211. Thus, the speed of the bullet is maintained at an original speed at which the bullet is discharged from the muzzle 20 even though the bullet passed through the elastic ring 300.

In addition, even when the inner diameter of the elastic ring 300 is changed by the pressure applied by the first insertion unit 210, if the reduced inner diameter of the elastic ring 300 is greater than the diameter of the bullet, frictional force is not applied to the bullet, and thus, the speed of the bullet is maintained at an original speed when the bullet exits the elastic ring 300.

The elastic ring 300 may be formed of an elastic material. In one embodiment, the elastic ring 300 may include silicone rubber or formed of silicone rubber. Since the elastic ring 300 expands/contracts due to temperature variation (the harness of the elastic ring 300 also changes due to temperature variation), the deceleration amount of the bullet may also vary due to temperature variation. Thus, in order to provide a bullet decelerator for a toy gun having a constant bullet deceleration rate despite of temperature variation, the elastic ring 300 may be formed of a material having a low thermal expansion (harness) coefficient. By minimizing change in volume and hardness of the elastic ring 300 by using silicone rubber having a low thermal expansion (harness) coefficient, the elastic ring 300 may provide a steady bullet speed deceleration rate.

Figure 4:
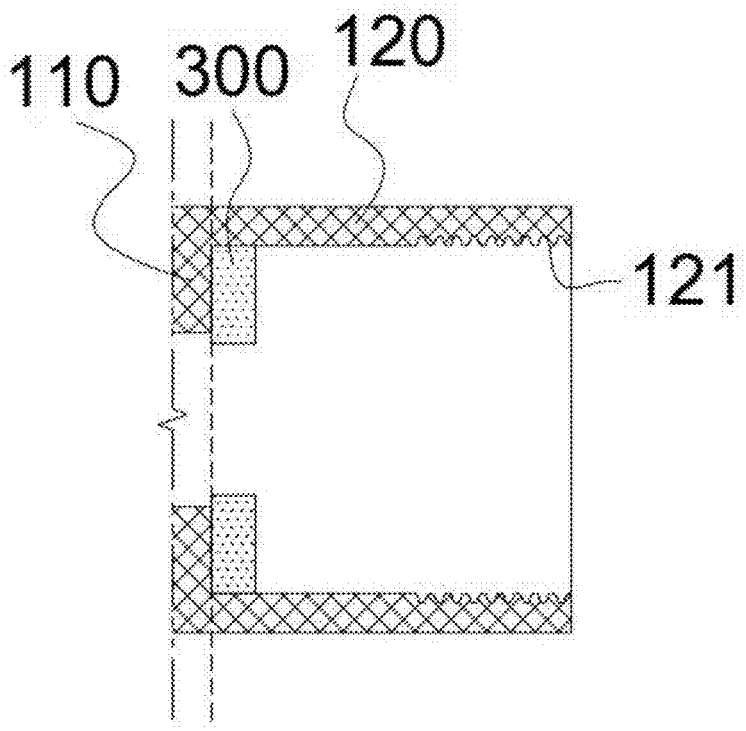
FIG. 4 shows an exemplary view of arrangements of elastic rings according to embodiments of the present disclosure.
Figure 5:
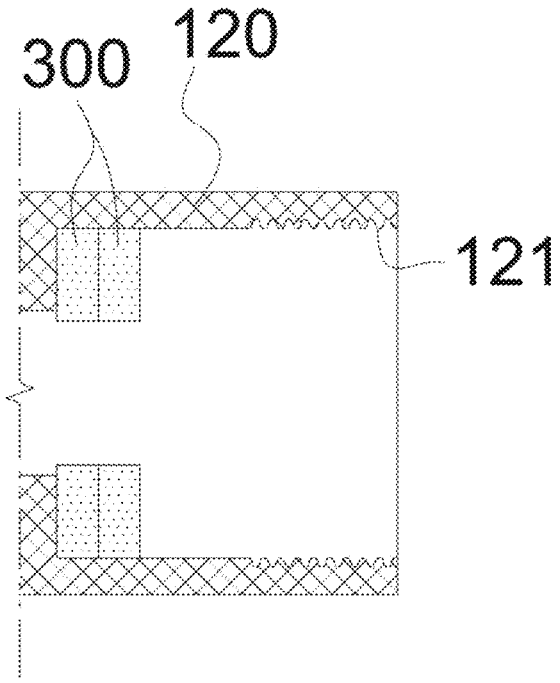
FIG. 5 shows an exemplary view of arrangements of elastic rings according to embodiments of the present disclosure.
Figure 6:
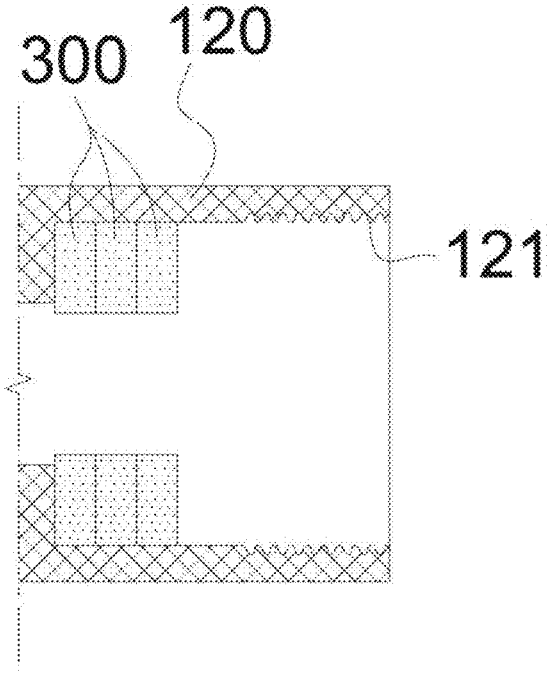
FIG. 6 shows an exemplary view of arrangements of elastic rings according to embodiments of the present disclosure.

FIGS. 4 to 6 show exemplary views of arrangements of elastic rings 300 according to embodiments of the present disclosure. In the present disclosure, the elastic ring 300 may be variously disposed and seated inside the second cover unit 120. Specifically, when using a single elastic ring 300, as shown in FIG. 4, the elastic ring 300 is disposed inside the second cover unit 120. In this case, one side surface of the elastic ring 300 is supported by the first cover unit 110, and the first insertion unit 210 of the second housing 200 may apply pressure to an opposite side surface of the elastic ring 300. The inner diameter of the elastic ring 300 may vary due to the pressure provided by the first insertion unit 210.

As shown in FIGS. 5 and 6, two or three elastic rings 300 may be disposed inside the second cover unit 120 as needed. In this case, the two or three elastic rings 300 may be placed inside the second cover unit 120, and the first insertion unit 210 may provide pressure thereto. For example, one elastic ring having a thickness of 3 mm, two elastic rings each having a thickness of 1.5 mm, or three elastic rings each having a thickness of 1 mm may be placed inside the second cover unit 120.

Figure 7:
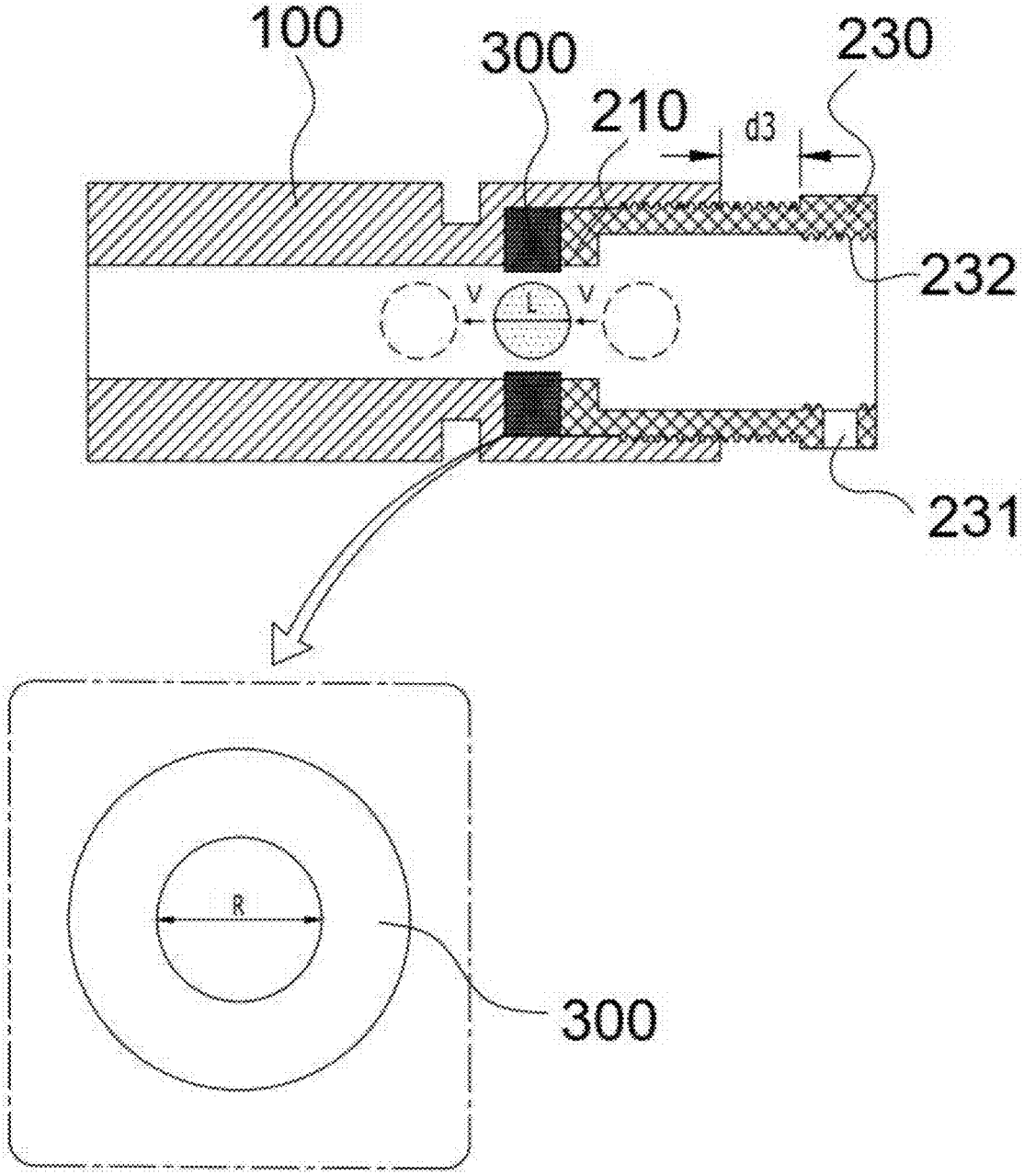
FIG. 7 shows a cross-sectional view of a bullet decelerator for a toy gun according to embodiments of the present disclosure.
Figure 8:
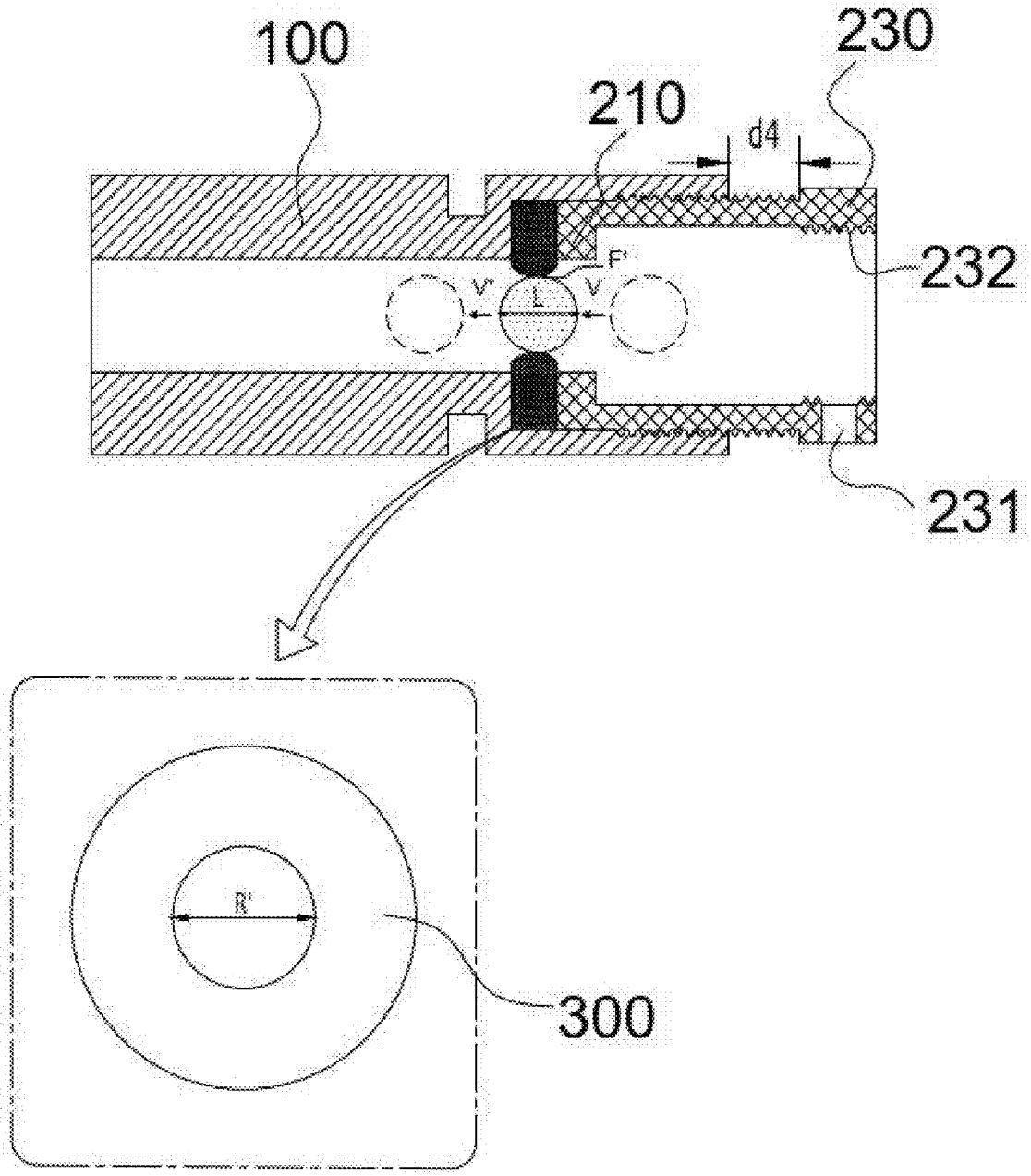
FIG. 8 shows a cross-sectional view of a bullet decelerator for a toy gun according to embodiments of the present disclosure.
Figure 9:
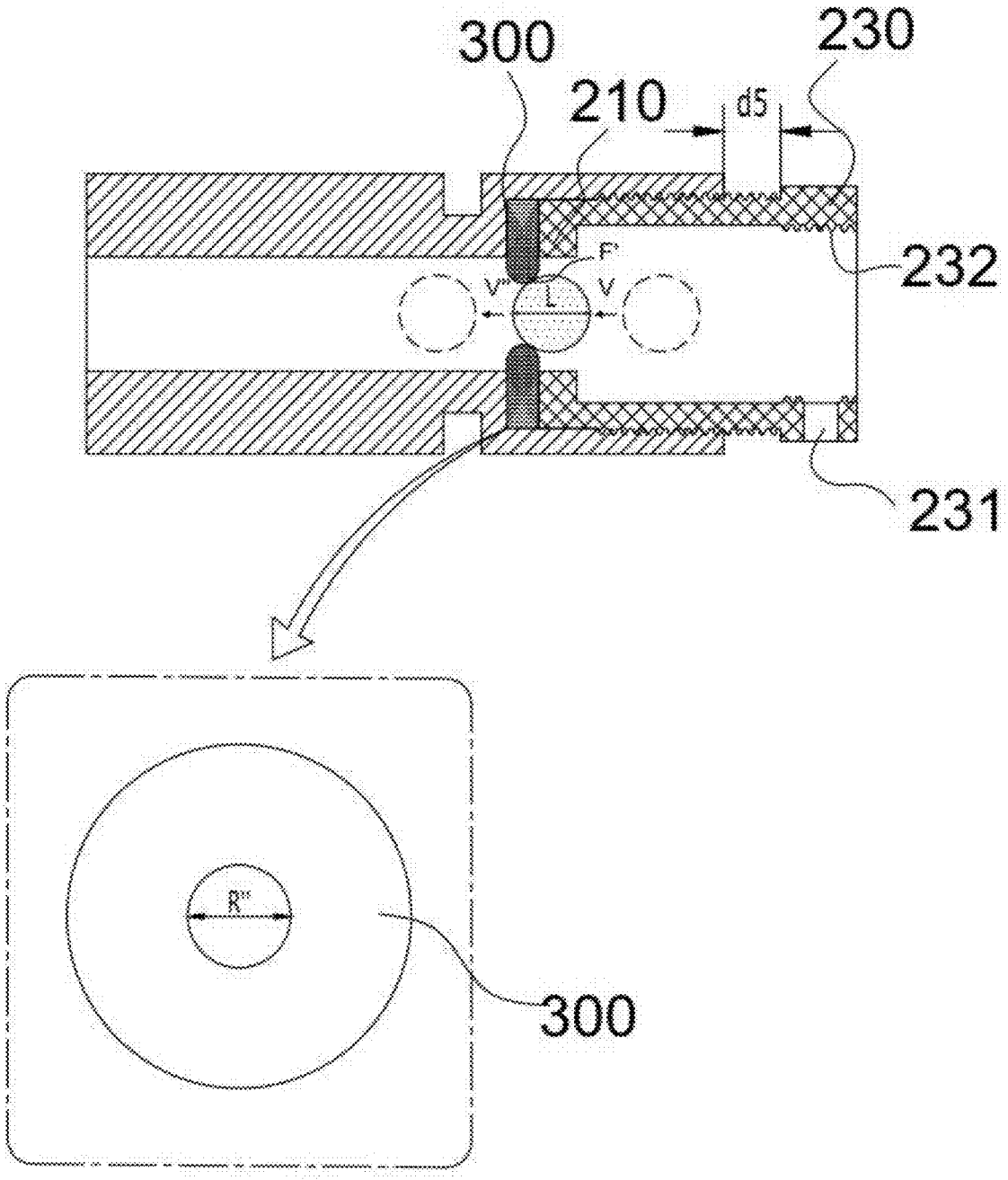
FIG. 9 shows a cross-sectional view of a bullet decelerator for a toy gun according to embodiments of the present disclosure.

FIGS. 7 to 9 show cross-sectional views of a bullet decelerator for a toy gun according to embodiments of the present disclosure. As shown in FIGS. 7 to 9, the first housing 100 and the second housing 200 may be configured to be fixedly coupled to each other. Specifically, the first screw thread 121 formed in the first housing 100 and the second screw thread 221 formed in the second housing 200 may be screw-coupled. The distance between the first housing 100 and the coupling unit 230 may be adjusted by rotating the first housing 100 or the second housing 200 thereby adjusting the coupling distance between the first screw thread 121 and the second screw thread 221.

In one embodiment, when the distance between the first housing 100 and the coupling unit 230 is d3 as shown in FIG. 7, since the first insertion unit 210 comes into close contact with the elastic ring 300 only to support the elastic ring 300. Thus, the first insertion unit 210 does not to apply any pressure to the elastic ring 300, and the shape of the elastic ring 300 is not changed.

Therefore, the inner diameter R of the elastic ring 300 is not changed and frictional force is not provided to a bullet discharged from the second outlet 211. Accordingly, the elastic ring 300 does not decelerate the original bullet speed V that has been discharged from the muzzle when the bullet passes therethrough. Herein, the inner diameter R of the elastic ring 300 may be greater than the diameter L of the bullet.

FIG. 7 shows an embodiment where the bullet speed discharged from the muzzle 20 of the toy gun corresponds to a safe speed and there is no risk of an accident caused by the bullet. In this case, since the bullet does not need to be decelerated, the bullet may exit the bullet decelerator without contacting the elastic ring 300 thereby maintaining the original bullet speed V.

FIG. 8 shows an embodiment where the distance between the first housing 100 and the coupling unit 230 is adjusted to d4, which is less than the distance d3 shown in FIG. 7, by using the first screw thread 121 formed in the first housing 100 and the second screw thread 221 formed in the second housing 200.

In this case, the first insertion unit 210 may apply pressure to the elastic ring 300. Accordingly, the first insertion unit 210 may apply a pressing force to the elastic ring 300. Herein, the thickness of the elastic ring 300 decreases due to the pressure, causing the inner diameter of the elastic ring 300 to decrease to R', which is equal to the diameter L of a bullet.

Thus, the elastic ring 300 may provide a frictional force F to the bullet discharged from the second outlet 211 to reduce the speed of the bullet to V', which is slower than the original bullet speed V. Thus, the bullet may exit the elastic ring 300 at a reduced speed.

FIG. 9 shows another embodiment where the distance between the first housing 100 and the coupling unit 230 is adjusted to d5, which is less than the interval d4 shown in FIG. 8, by adjusting the distance between the first housing 100 and the second housing 200 using the first screw thread 121 formed in the first housing 100 and the second screw thread 221 formed in the second housing 200.

In this case, the elastic ring 300 may receive a pressing force greater than the pressing force provided by the first insertion unit 210 in the embodiment shown in FIG. 8. As described above, the thickness of the elastic ring 300 may be decreased due to the pressing force, causing the inner diameter of the elastic ring to decrease. Herein, the inner diameter of the elastic ring 300 may be reduced to R" which is less than the diameter L of the bullet.

Thus, the elastic ring 300 may provide frictional force F' greater than the frictional force F shown in FIG. 8 to the bullet discharged from the second outlet thereby reducing the speed of the bullet to V" which is slower than V' shown in FIG. 8. In this case, the bullet may exit the elastic ring 300 by pushing a portion of the elastic ring 300 in the left direction.

FIGS. 8 and 9 show embodiments where the bullet speed discharged from the muzzle 20 of the toy gun does not correspond to a safe speed and there is a risk of an accident caused by the bullet. In these cases, since the bullet needs to be decelerated, the bullet may exit the bullet decelerator after coming into contact with the elastic ring, causing the speed of the bullet to be reduced.

As described above, according to the present disclosure, a bullet may be discharged after changing or maintaining the bullet speed by the bullet decelerator coupled to the muzzle of the toy gun to ensure that the bullet is discharged at a safety speed, thereby preventing accidents that may be caused by the bullet.

FIG. 11 shows a table illustrating bullet speed of an electric airsoft gun with a bullet decelerator attached thereto at room temperature (25° C.). In this embodiment, the bullet speed of the electric airsoft gun, which has a substantially constant muzzle speed, has been measured while varying the thickness of the elastic ring and the inner diameter of the first cover unit. By using an electric airsoft gun discharging a bullet at 300 fps, 20 rounds of 6 mm plastic balls having 0.2 g weight have been fired for each condition. In order to decelerate the bullet speed to a safe speed, the bullet decelerator for a toy gun may be configured to decelerate the bullet speed by 50%, i.e., 150 fps.

As shown in FIG. 11, in the case of the electric airsoft gun using a first cover unit having an inner diameter of 8.5 mm and an elastic ring having a thickness of 4 mm at room temperature (25° C.), bullets are not fired normally. When such a jam phenomenon occurs, the plastic ball may be trapped inside the bullet decelerator or the toy gun, and the interior of the airsoft gun may be damaged due to compressed air caused by the jammed plastic ball or the next plastic ball fired by the user. Thus, when the inner diameter of the first cover unit is too small, a bullet jam may be caused, and in serious cases, damage may be caused to the airsoft gun.

In addition, in the case of the electric airsoft gun using a first cover unit having an inner diameter of 9.5 mm and an elastic ring having a thickness of 2 mm at room temperature (25° C.), bullets are fired at a speed near the target speed of 150 fps up to the fifth bullet. However, after the sixth bullet, the speed of the bullets is not reduced, and the bullets are fired at a speed near the original speed of 300 fps. This may occur when the first cover unit does not sufficiently support the elastic ring due to a large inner diameter of the first cover unit. In such a case, the elastic ring may be detached from its fixed position and exit the bullet decelerator along with the bullet.

FIG. 12 shows a table illustrating bullet speed of a gas-powered airsoft gun with a bullet decelerator attached thereto at room temperature (25° C.). In this embodiment, the bullet speed of the gas-powered airsoft gun has been measured while varying the thickness of the elastic ring and the inner diameter of the first cover unit. By using a gas-powered airsoft gun discharging a bullet at 300 fps, 20 rounds of 6 mm plastic balls having 0.2 g weight have been fired for each condition. Gas-powered airsoft guns use pneumatic potential energy stored within compressed gas to drive the shooting mechanism, and thus, bullet speed changes according to change in gas pressure and external temperature. In order to decelerate the bullet speed to a safe speed, the bullet decelerator for a toy gun may be configured to decelerate the bullet speed by 50%, i.e., 150 fps.

As shown in FIG. 12, in the case of the gas-powered airsoft gun using a first cover unit having an inner diameter of 8.5 mm and an elastic ring having a thickness of 4 mm at room temperature (25° C.), bullets are not fired normally. In addition, in the case of the gas-powered airsoft gun using a first cover unit having an inner diameter of 9.5 mm and an elastic ring having a thickness of 2 mm at room temperature (25° C.), bullets are fired at a speed near the target speed of 150 fps up to the eleventh bullet. However, after the eleventh bullet, the speed of the bullets is not reduced as intended. This may occur when the first cover unit does not sufficiently support the elastic ring due to a large inner diameter of the first cover unit. In such a case, the elastic ring may be detached from its fixed position and exit the bullet decelerator along with the bullet. Additionally, in the case of the gas-powered airsoft gun using a first cover unit having an inner diameter of 9 mm and an elastic ring having a thickness of 2 mm at room temperature (25° C.), bullets are fired at a speed near the target speed of 150 fps up to the fourteenth bullet. However, after the fourteenth bullet, the speed of the bullets is not reduced as intended.

FIG. 13 shows a table illustrating bullet speed of an electric airsoft gun with a bullet decelerator attached thereto at a low temperature (10° C.). In this embodiment, the bullet speed of the electric airsoft gun has been measured while varying the thickness of the elastic ring and the inner diameter of the first cover unit. By using an electric airsoft gun discharging a bullet at 300 fps, 20 rounds of 6 mm plastic balls having 0.2 g weight have been fired for each condition. In order to decelerate the bullet speed to a safe speed, the bullet decelerator for a toy gun may be configured to decelerate the bullet speed by 50%, i.e., 150 fps.

As shown in FIG. 13, in the case of the electric airsoft gun using a first cover unit having an inner diameter of 8.5 mm and an elastic ring having a thickness of 4 mm at a low temperature (10° C.), bullets are not fired normally. In addition, in the case of the electric airsoft gun using a first cover unit having an inner diameter of 9.5 mm and an elastic ring having a thickness of 2 mm at a low temperature (10° C.), bullets are fired at a speed near the target speed of 150 fps up to the second bullet. However, after the second bullet, the speed of the bullets is not reduced as intended. This may occur when the first cover unit does not sufficiently support the elastic ring due to a large inner diameter of the first cover unit. In such a case, the elastic ring may be detached from its fixed position and exit the bullet decelerator along with the bullet.

FIG. 14 shows a table illustrating bullet speed of a gas-powered airsoft gun with a bullet decelerator attached thereto at a low temperature (10° C.). In this embodiment, the bullet speed of the gas-powered airsoft gun has been measured while varying the thickness of the elastic ring and the inner diameter of the first cover unit. By using a gas-powered airsoft gun discharging a bullet at 300 fps, 20 rounds of 6 mm plastic balls having 0.2 g weight have been fired for each condition. In order to decelerate the bullet speed to a safe speed, the bullet decelerator for a toy gun may be configured to decelerate the bullet speed by 50%, i.e., 150 fps.

As shown in FIG. 14, in the case of the gas-powered airsoft gun using a first cover unit having an inner diameter of 8.5 mm and an elastic ring having a thickness of 4 mm at a low temperature (10° C.), bullets are not fired normally. In addition, in the case of the gas-powered airsoft gun using a first cover unit having an inner diameter of 9.5 mm and an elastic ring having a thickness of 2 mm at a low temperature (10° C.), bullets are fired at a speed near the target speed of 150 fps up to the tenth bullet. However, after the tenth bullet, the speed of the bullets is not reduced as intended.

As shown in FIGS. 11 to 14, by using a first cover unit having an inner diameter of 9.0 mm, the influence of temperature change may be minimized so that the bullet speed may be controlled steadily regardless of the thickness of the elastic ring, providing good results for both electric airsoft guns and gas-powered airsoft guns. Therefore, when using a 6 mm bullet, the first cover unit of the bullet decelerator for a toy gun may be configured to have an inner diameter of about 9 mm (8.95 mm to 9.05 mm) in consideration of manufacturing deviations. As described above, when the inner diameter of the first cover unit is set to about 9 mm, bullet jamming may be prevented, and a separation of the elastic ring may also be prevented. In addition, the second cover unit of the bullet decelerator for a toy gun may be configured to have an inner diameter of about 14 mm (13.95 mm to 14.05 mm).

As described above, the bullet decelerator for a toy gun according to the present disclosure may be coupled to the muzzle of the toy gun to maintain or reduce the bullet speed. Thus, a bullet may be discharged after changing the bullet speed to a safety speed thereby preventing accidents caused by airsoft bullets (e.g., plastic balls). Further, the deceleration rate may be variably adjusted.

Although the bullet decelerator for a toy gun according to the present disclosure has been described above with reference to the illustrated drawings, the present disclosure is not limited to the embodiments and drawings disclosed in this specification but may be modified in various ways by those skilled in the art without departing from the technical spirit of the present disclosure.

The above detailed description includes references to the accompanying drawings, which form a part of the detailed description. The drawings show, by way of illustration, specific embodiments that may be practiced. These embodiments are also referred to herein as "examples." Such examples may include elements in addition to those shown or described. However, also contemplated are examples that include the elements shown or described. Moreover, also contemplate are examples using any combination or permutation of those elements shown or described (or one or more aspects thereof), either with respect to a particular example (or one or more aspects thereof), or with respect to other examples (or one or more aspects thereof) shown or described herein.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "comprising," "including," and "having" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to suggest a numerical order for their objects.

The above description is intended to be illustrative, and not restrictive. For example, the above-described examples (or one or more aspects thereof) may be used in combination with others. Other embodiments may be used, such as by one of ordinary skill in the art upon reviewing the above description. The Abstract is to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. However, the claims may not set forth every feature disclosed herein as embodiments may feature a subset of said features. Further, embodiments may include fewer features than those disclosed in a particular example. Thus, the following claims are hereby incorporated into the Detailed Description, with a claim standing on its own as a separate embodiment. The scope of the embodiments disclosed herein is to be determined with reference to the appended claims, along with the full scope of equivalents to which such claims are entitled.

What is claimed is:

1. A bullet decelerator for a toy gun, comprising:

a first housing having a first outlet, wherein a bullet is discharged from the first outlet;

a second housing having a second outlet formed on one end of the second housing, wherein the bullet is discharged from the second outlet and the second housing is screw-coupled to the first housing; and an elastic ring disposed within the first housing, the elastic ring is configured to maintain or reduce speed of the bullet discharged from the second outlet, wherein the first housing includes:

a first cover unit having the first outlet; and a second cover unit integrally connected to the first cover unit and configured to accommodate the elastic ring therein, a first screw thread is formed on at least a portion of an inner circumferential surface of the second cover unit, the first screw thread is configured to couple the first housing and the second housing, and the elastic ring is formed of silicone rubber, wherein one side surface of the elastic ring is supported by the first cover unit, and an inner diameter of the elastic ring decreases as a thickness of the elastic ring decreases by the second housing applying pressure to an opposite side surface of the elastic ring.

2. The bullet decelerator of claim 1, wherein the second housing includes:

a first insertion unit having the second outlet, wherein the first insertion unit applies pressure to the elastic ring; and a second insertion unit integrally connected to the first insertion unit having an outer circumferential surface on which a second screw thread is formed, wherein the second screw thread correspondingly couples to the first screw thread.

3. The bullet decelerator of claim 2, wherein the second housing further includes a coupling unit integrally connected to the second insertion unit configured to be coupled to a muzzle.

4. The bullet decelerator of claim 3, wherein the coupling unit has a third screw thread formed on an inner circumferential surface of the coupling unit, and the third screw thread is configured to be screw-coupled to the muzzle.

5. The bullet decelerator of claim 4, wherein the coupling unit has a through- hole communicating with a communication hole formed in the muzzle, and a coupling member is inserted into the through-hole and the communication hole to couple the coupling unit to the muzzle.

6. The bullet decelerator of claim 1, wherein the first cover unit has an inner diameter of 8.95 mm to 9.05 mm.

* * * * *